US006435823B1

(12) United States Patent
Schroder

(10) Patent No.: US 6,435,823 B1
(45) Date of Patent: Aug. 20, 2002

(54) BUCKET TIP CLEARANCE CONTROL SYSTEM

(75) Inventor: Mark Stewart Schroder, Hendersonville, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/731,907

(22) Filed: Dec. 8, 2000

(51) Int. Cl.[7] ..... F01D 11/08

(52) U.S. Cl. ..... 415/173.1; 415/213.1; 415/220

(58) Field of Search ..... 415/173.1, 175, 415/176, 178, 213.1, 220, 173.2

(56) References Cited

U.S. PATENT DOCUMENTS

| | | | | |
|---|---|---|---|---|
| 4,329,114 A | * | 5/1982 | Johnston et al. | 415/145 |
| 4,525,998 A | | 7/1985 | Schwarz | |
| 5,064,343 A | * | 11/1991 | Mills | 415/173.3 |
| 5,167,488 A | | 12/1992 | Ciokajlo et al. | |
| 5,212,940 A | | 5/1993 | Glover | |
| 5,219,968 A | * | 6/1993 | Johnson | 415/115 |
| 5,228,828 A | | 7/1993 | Damlis et al. | |
| 5,593,274 A | | 1/1997 | Carreno et al. | |
| 5,605,437 A | | 2/1997 | Meylan | |
| 5,667,358 A | | 9/1997 | Gaul | |
| 5,685,693 A | | 11/1997 | Sexton et al. | |
| 5,779,436 A | * | 7/1998 | Glezer et al. | 415/115 |
| 5,779,442 A | | 7/1998 | Sexton et al. | |
| 5,967,743 A | | 10/1999 | Meylan | |
| 6,082,963 A | | 7/2000 | Sexton et al. | |

OTHER PUBLICATIONS

"39$^{th}$ GE Turbine State–of–the–Art Technology Seminar", Tab 1,""F" Technology—the First Half–Million Operating Hours", H.E. Miller, Aug. 1996.

"39th GE Turbine State–of–the–Art Technology Seminar", Tab 2, "GE Heavy–Duty Gas Turbine Performance Characteristics", F. J. Brooks, Aug. 1996.

"39th GE Turbine State–of–the–Art Technology Seminar", Tab 3, "9EC 50Hz 170–MW Class Gas Turbine", A. S. Arrao, Aug. 1996.

"39th GE Turbine State–of–the–Art Technology Seminar", Tab 4, "MWS6001FA—An Advanced–Technology 70–MW Class 50/60 Hz Gas Turbine", Ramachandran et al., Aug. 1996.

"39th GE Turbine State–of–the–Art Technology Seminar", Tab 5, "Turbomachinery Technology Advances at Nuovo Pignone", Benvenuti et al., Aug. 1996.

"39th GE Turbine State–of–the–Art Technology Seminar", Tab 6, "GE Aeroderivative Gas Turbines—Design and Operating Features", M.W. Horner, Aug. 1996.

"39th GE Turbine State–of–the–Art Technology Seminar", Tab 7, "Advance Gas Turbine Materials and Coatings", P.W. Schilke, Aug. 1996.

(List continued on next page.)

*Primary Examiner*—Edward K. Look
*Assistant Examiner*—Ninh Nguyen
(74) *Attorney, Agent, or Firm*—Nixon & Vanderhye P.C.

(57) ABSTRACT

A bucket tip clearance control system forms part of a turbomachinery apparatus including a casing, an outer shroud coupled with the casing, and an inner shroud coupled with the outer shroud. The tip clearance control system includes a flow circuit for a thermal medium defining a flow path within the outer shroud. A thermal medium source delivers the thermal medium to the flow circuit in a predefined condition according to operating parameters of the turbomachinery apparatus. The temperature of the outer shroud is controlled according to the predefined condition of the thermal medium. By accurately controlling the temperature of the outer shroud, bucket tip clearance can be controlled and optimized during all of the various operation stages of turbomachinery.

12 Claims, 5 Drawing Sheets

OTHER PUBLICATIONS

"39th GE Turbine State–of–the–Art Technology Seminar", Tab 8, "Dry Low $NO_x$ Combustion Systems for GE Heavy–Duty Turbines", L. B. Davis, Aug. 1996.
"39th GE Turbine State–of–the–Art Technology Seminar", Tab 9, "GE Gas Turbine Combustion Flexibility", M. A. Davi, Aug. 1996.
"39th GE Turbine State–of–the–Art Technology Seminar", Tab 10, "Gas Fuel Clean–Up System Design Considerations for GE Heavy–Duty Gas Turbines", C. Wilkes, Aug. 1996.
"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H" Gas Turbine Combined Cycles", Paul et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines,"J. R. Johnston, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for STAG™ Combined–Cycle Power Systems", M. Boss, Aug. 1996.
"39th GE Turbine State–of–the–Art Technology Seminar", Tab 26, "Cogeneration Application Considerations", Fisk et al., Aug. 1996.
"39th GE Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power–Density™ Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technology" J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program—Conceptual Design and Product Development", Annual Report, Sep. 1, 1994—Aug. 31, 1995.
"Advanced Turbine Systems (ATS Program) Conceptual Design and Product Development", Final Technical Progress Report, vol. 2– Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993—Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report No. DE–FC21–95MC31176–11.
"Exhibit panels used at 1995 product introduction at PowerGen Europe".

"Extensive Testing Program Validates High Efficiency, reliability of GE's Advanced "H" Gas Turbine Technology", Press Information, Press Release, 96–NR14, Jun. 26, 1996, H Technology Tests/pp. 1–4.

"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.

"Gas, Steam Turbine Work as Single Unit in GE's Advanced H Technology Combined–Cycle System", Press Information, Press Release, 95–NR18, May 16, 1995, Advanced Technology Introduction/pp. 1–3.

"GE Breaks 60% Net Efficiency Barrier" paper, 4 pages.

"GE Businesses Share Technologies and Experts to Develop State–Of–The–Art Products", Press Information, Press Release 95–NR10, May 16, 1995, GE Technology Transfer/pp. 1–3.

"General Electric ATS Program Technical Review, Phase 2 Activities", T. Chance et al., pp. 1–4.

"General Electric's DOE/ATS H Gas Turbine Development" Advanced Turbine Systems Annual Review Meeting, Nov. 7–8, 1996, Washington, D.C., Publication Release.

"H Technology Commercialization", 1998 MarComm Activity Recommendation, Mar., 1998.

"H Technology", Jon Ebacher, VP, Power Gen Technology, May 8, 1998.

"H Testing Process", Jon Ebacher, VP, Power Gen Technology, May 8, 1998.

"Heavy–Duty & Aeroderivative Products" Gas Turbines, Brochure, 1998.

"MS7001H/MS9001H Gas Turbine, gepower.com website for PowerGen Europe" Jun. 1–3 going public Jun. 15, (1995).

"New Steam Cooling System is a Key to 60% Efficiency For GE "H" Technology Combined–Cycle Systems", Press Information, Press Release, 95–NRR16, May 16, 1995, H Technology/pp. 1–3.

"Overview of GE's H Gas Turbine Combined Cycle", Jul. 1, 1995 to Dec. 31, 1997.

"Power Systems for the 21$^{st}$ Century—"H" Gas Turbine Combined Cycles", Thomas C. Paul et al., Report.

"Power–Gen '96 Europe", Conference Programme, Budapest, Hungary, Jun. 26–28, 1996.

"Power–Gen International", 1998 Show Guide, Dec. 9–11, 1998, Orange County Convention Center, Orlando, Florida.

"Press Coverage following 1995 product announcement"; various newspaper clippings relating to improved generator.

"Proceedings of the Advanced Turbine Systems Annual Program Review Meeting", vol. I, "Industrial Advanced Turbine Systems Program Overview", D.W. Esbeck, pp. 3–13, Oct., 1995.

"Proceedings of the Advanced Turbine Systems Annual Program Review Meeting", vol. I, "H Gas Turbine Combined Cycle", J. Corman, pp. 14–21, Oct., 1995.

"Proceedings of the Advanced Turbine Systems Annual Program Review Meeting", vol. I, "Overview of Westinghouse's Advanced Turbine Systems Program", Bannister et al., pp. 22–30, Oct., 1995.

"Proceedings of the Advanced Turbine Systems Annual Program Review Meeting", vol. I, "Allison Engine ATS Program Technical Review", D. Mukavetz, pp. 31–42, Oct., 1995.

"Proceedings of the Advanced Turbine Systems Annual Program Review Meeting", vol. I, "Advanced Turbine Systems Program Industrial System Concept Development", S. Gates, pp. 43–63, Oct., 1995.

"Proceedings of the Advanced Turbine Systems Annual Program Review Meeting", vol. I, "Advanced Turbine System Program Phase 2 Cycle Selection", Latcovich, Jr., pp. 64–69, Oct., 1995.

"Proceedings of the Advanced Turbine Systems Annual Program Review Meeting", vol. I, "General Electric ATS Program Technical Review Phase 2 Activities", Chance et al., pp. 70–74, Oct., 1995.

"Proceedings of the Advanced Turbine Systems Annual Program Review Meeting", vol. I, "Technical Review of Westinghouse's Advanced Turbine Systems Program", Diakunchak et al., pp. 75–86, Oct., 1995.

"Proceedings of the Advanced Turbine Systems Annual Program Review Meeting", vol. I, "Advanced Combustion Turbines and Cycles: An EPRI Perspective", Touchton et al., pp. 87–88, Oct., 1995.

"Proceedings of the Advanced Turbine Systems Annual Program Review Meeting", vol. I, "Advanced Turbine Systems Annual Program Review", William E. Koop, pp. 89–92, Oct., 1995.

"Proceedings of the Advanced Turbine Systems Annual Program Review Meeting", vol. I, "The AGTSR Consortium: An Update", Fant et al., pp. 93–102, Oct., 1995.

"Proceedings of the Advanced Turbine Systems Annual Program Review Meeting", vol. I, "Overview of Allison/AGTSR Interactions", Sy A. Ali, pp. 103–106, Oct., 1995.

"Proceedings of the Advanced Turbine Systems Annual Program Review Meeting", vol. I, "Design Factors for Stable Lean Premix Combustion", Richards et al., pp. 107–113, Oct., 1995.

"Proceedings of the Advanced Turbine Systems Annual Program Review Meeting", vol. I, "Ceramic Stationary as Turbine", M. van Roode, pp. 114–147, Oct., 1995.

"Proceedings of the Advanced Turbine Systems Annual Program Review Meeting", vol. I, "DOE/Allison Ceramic Vane Effort", Wenglarz et al., pp. 148–151, Oct., 1995.

"Proceedings of the Advanced Turbine Systems Annual Program Review Meeting", vol. I, "Materials/Manufacturing Element of the Advanced Turbine Systems Program", Karnitz et al., pp. 152–160, Oct., 1995.

"Proceedings of the Advanced Turbine Systems Annual Program Review Meeting", vol. I, "Land–Based Turbine Casting Initiative", Mueller et al., pp. 161–170, Oct., 1995.

"Proceedings of the Advanced Turbine Systems Annual Program Review Meeting", vol. I, "Turbine Airfoil Manufacturing Technology", Kortovich, pp. 171–181, Oct., 1995.

"Proceedings of the Advanced Turbine Systems Annual Program Review Meeting", vol. I, "Pratt & Whitney Thermal Barrier Coatings", Bornstein et al., pp. 182–193, Oct., 1995.

"Proceedings of the Advanced Turbine Systems Annual Program Review Meeting", vol. I, "Westinhouse Thermal Barrier Coatings", Goedjen et al., pp. 194–199, Oct., 1995.

"Proceedings of the Advanced Turbine Systems Annual Program Review Meeting", vol. I, "High Performance Steam Development", Duffy et al., pp. 200–220, Oct., 1995.

"Proceedings of the Advanced Turbine Systems Annual Program Review Meeting", vol. II, "Lean Premixed Combustion Stabilized by Radiation Feedback and heterogeneous Catalysis", Dibble et al., pp. 221–232, Oct., 1995.

"Proceedings of the Advanced Turbine Systems Annual Program Review Meeting", vol. II, Rayleigh/Raman/LIF Measurements in a Turbulent Lean Premixed Combustor, Nandula et al. pp. 233–248, Oct., 1995.

"Proceedings of the Advanced Turbine Systems Annual Program Review Meeting", vol. II, "Lean Premixed Flames for Low $No_x$ Combustors", Sojka et al., pp. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems", Banovic et al., pp. 276–280, Oct., 1995.

"Proceedings of the Advanced Turbine Systems Annual Program Review Meeting", vol. II, "Advanced Turbine Cooling, Heat Transfer, and Aerodynamic Studies", Han et al., pp. 281–309, Oct., 1995.

"Proceedings of the Advanced Turbine Systems Annual Program Review Meeting", vol. II, "Life Prediction of Advanced Materials for Gas Turbine Application", Zamrik et al., pp. 310–327, Oct., 1995.

"Proceedings of the Advanced Turbine Systems Annual Program Review Meeting", vol. II, "Advanced Combustion Technologies for Gas Turbine Power Plants", Vandsburger et al., pp. 328–352, Oct., 1995.

"Proceedings of the Advanced Turbine Systems Annual Program Review Meeting", vol. II, "Combustion Modeling in Advanced Gas Turbine Systems", Smoot et al., pp. 353–370, Oct., 1995.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. pp. 371–390, Oct., 1995.

"Proceedings of the Advanced Turbine Systems Annual Program Review Meeting", vol. II, "Rotational Effects on Turbine Blade Cooling", Govatzidakia et al., pp. 391–392, Oct., 1995.

"Proceedings of the Advanced Turbine Systems Annual Program Review Meeting", vol. II, "Manifold Methods for Methane Combustion", Yang et al., pp. 393–409, Oct., 1995.

"Proceedings of the Advanced Turbine Systems Annual Program Review Meeting", vol. II, "Advanced Multistage Turbine Blade Aerodynamics, Performance, Cooling, and Heat Transfer", Fleeter et al., pp. 410–414, Oct., 1995.

"Proceedings of the Advanced Turbine Systems Annual Program Review Meeting, vol. II", The Role of Reactant Unmixedness, Strain Rate, and Length Scale on Premixed Combustor Performance, Samuelsen et al., pp. 415–422, Oct., 1995.

"Proceedings of the Advanced Turbine Systems Annual Program Review Meeting", vol. II, "Experimental and Computational Studies of Film Cooling With Compound Angle Injection", Goldstein et al., pp. 423–451, Oct., 1995.

"Proceedings of the Advanced Turbine Systems Annual Program Review Meeting", vol. II, "Compatibility of Gas Turbine Materials with Steam Cooling", Desai et al., pp. 452–464, Oct., 1995.

"Proceedings of the Advanced Turbine Systems Annual Program Review Meeting", vol. II, "Use of a Laser–Induced Fluorescence Thermal Imaging System for Film Cooling Heat Transfer Measurement", M. K. Chyu, pp. 465–473, Oct., 1995.

"Proceedings of the Advanced Turbine Systems Annual Program Review Meeting", vol. II, Effects of Geometry on Slot–Jet Film Cooling Performance, Hyams et al., pp. 474–496 Oct., 1995.

"Proceedings of the Advanced Turbine Systems Annual Program Review Meeting", vol. II, "Steam as Turbine Blade Coolant: Experimental Data Generation", Wilmsen et al., pp. 497–505, Oct., 1995.

"Proceedings of the Advanced Turbine Systems Annual Program Review Meeting", vol. II, "Combustion Chemical Vapor Deposited Coatings for Thermal Barrier Coating Systems", Hampikian et al., pp. 506–515, Oct., 1995.

"Proceedings of the Advanced Turbine Systems Annual Program Review Meeting", vol. II, "Premixed Burner Experiments: Geometry, Mixing, and Flame Structure Issues", Gupta et al., pp. 516–528, Oct., 1995.

"Proceedings of the Advanced Turbine Systems Annual Program Review Meeting", "Intercooler Flow Path for Gas Turbines: CFD Design and Experiments", Agrawal et al., pp. 529–538, Oct., 1995.

"Proceedings of the Advanced Turbine Systems Annual Program Review Meeting", vol. II, "Bond Strength and Stress Measurements in Thermal Barrier Coatings", Gell et al., pp. 539–549, Oct., 1995.

"Proceedings of the Advanced Turbine Systems Annual Program Review Meeting", vol. II, "Active Control of Combustion Instabilities in Low $NO_x$ Gas Turbines", Zinn et al., pp. 550–551, Oct., 1995.

"Proceedings of the Advanced Turbine Systems Annual Program Review Meeting", vol. II, "Combustion Instability Modeling and Analysis", Santoro et al., pp. 552–559, Oct., 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., pp. 560–565, Oct., 1995.

"Proceedings of the Advanced Turbine Systems Annual Program Review Meeting", vol. II, "Heat Pipe Turbine Vane Cooling", Langston et al., pp. 566–572, Oct., 1995.

"Proceedings of the Advanced Turbine Systems Annual Program Review Meeting", vol. II, "Improved Modeling Techniques for Turbomachinery Flow Fields", Lakshminarayana et al., pp. 573–581, Oct., 1995.

"Proceedings of the Advanced Turbine Systems Annual Program Review Meeting", vol. II, "Advanced 3D Inverse Method for Designing Turbomachine Blades", T. Dang, p. 582, Oct., 1995.

"Proceedings of the Advanced Turbine Systems Annual Program Review Meeting", "ATS and the Industries of the Future", Denise Swink, p. 1, Nov., 1996.

"Proceedings of the Advanced Turbine Systems Annual Program Review Meeting", "Gas Turbine Association Agenda", William H. Day, pp. 3–16, Nov., 1996.

"Proceedings of the Advanced Turbine Systems Annual Program Review Meeting", "Power Needs in the Chemical Industry", Keith Davidson, pp. 17–26, Nov., 1996.

"Proceedings of the Advanced Turbine Systems Annual Program Review Meeting", "Advanced Turbine Systems Program Overview", David Esbeck, pp. 27–34, Nov., 1996.

"Proceedings of the Advanced Turbine Systems Annual Program Review Meeting", "Westinghouse's Advanced Turbine Systems Program", Gerard McQuiggan, pp. 35–48, Nov., 1996.

"Proceedings of the Advanced Turbine Systems Annual Program Review Meeting", "Overview of GE's H Gas Turbine Combined Cycle", Cook et al., pp. 49–72, Nov., 1996.

"Proceedings of the Advanced Turbine Systems Annual Program Review Meeting", "Allison Advanced Simple Cycle Gas Turbine System", William D. Weisbrod, pp. 73–94, Nov., 1996.

"Proceedings of the Advanced Turbine Systems Annual Program Review Meeting", "The AGTSR Industry–University Consortium", Lawrence P. Golan, pp. 95–110, Nov., 1996.

"Proceedings of the Advanced Turbine Systems Annual Program Review Meeting", "$NO_x$ and CO Emissions Models for Gas–Fired Lean–Premixed Combustion Turbines", A. Mellor, pp. 111–122, Nov., 1996.

"Proceedings of the Advanced Turbine Systems Annual Program Review Meeting", "Methodologies for Active Mixing and Combustion Control", Uri Vandsburger, pp. 123–156, Nov., 1996.

"Proceedings of the Advanced Turbine Systems Annual Program Review Meeting", "Combustion Modeling in Advanced Gas Turbine Systems", Paul O. Hedman, pp. 157–180, Nov., 19967.

"Proceedings of the Advanced Turbine Systems Annual Program Review Meeting", "Manifold Methods for Methane Combustion", Stephen B. Pope, pp. 181–188, Nov., 1996.

"Proceedings of the Advanced Turbine Systems Annual Program Review Meeting", "The Role of Reactant Unmixedness, Strain Rate, and Length Scale on Premixed Combustor Performance", Scott Samuelsen, pp. 189–210, Nov., 1996.

"Proceedings of the Advanced Turbine Systems Annual Program Review Meeting", "Effect of Swirl and Momentum Distribution on Temperature Distribution in Premixed Flames", Ashwani K. Gupta, pp. 211–232, Nov., 1996.

"Proceedings of the Advanced Turbine Systems Annual Program Review Meeting", "Combustion Instability Studies Application to Land–Based Gas Turbine Combustors", Robert J. Santoro, pp. 233–252.

"Proceedings of the Advanced Turbine Systems Annual Program Review Meeting", Active Control of Combustion Instabilities in Low $NO_x$ Turbines, Ben T. Zinn, pp. 253–264, Nov., 1996.

"Proceedings of the Advanced Turbine Systems Annual Program Review Meeting", "Life Prediction of Advanced Materials for Gas Turbine Application," Sam Y. Zamrik, pp. 265–274, Nov., 1996.

"Proceedings of the Advanced Turbine Systems Annual Program Review Meeting", "Combustion Chemical Vapor Deposited Coatings for Thermal Barrier Coating Systems", W. Brent Carter, pp. 275–290, Nov., 1996.

"Proceedings of the Advanced Turbine Systems Annual Program Review Meeting", "Compatibility of Gas Turbine Materials with Steam Cooling", Vimal Desai, pp. 291–314, Nov., 1996.

"Proceedings of the Advanced Turbine Systems Annual Program Review Meeting", "Bond Strength and Stress Measurements in Thermal Barrier Coatings", Maurice Gell, pp. 315–334, Nov., 1996.

"Proceedings of the Advanced Turbine Systems Annual Program Review Meeting", "Advanced Multistage Turbine Blade Aerodynamics, Performance, Cooling and Heat Transfer", Sanford Fleeter, pp. 335–356, Nov., 1996.

"Proceedings of the Advanced Turbine Systems Annual Program Review Meeting", "Flow Characteristics of an Intercooler System for Power Generating Gas Turbines", Ajay K. Agrawal, pp. 357–370, Nov., 1996.

"Proceedings of the Advanced Turbine Systems Annual Program Review Meeting", "Improved Modeling Techniques for Turbomachinery Flow Fields", B. Lakshiminarayana, pp. 371–392, Nov., 1996.

"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, pp. 393–406, Nov., 1996.

"Proceedings of the Advanced Turbine Systems Annual Program Review Meeting", "Advanced Turbine Cooling, Heat Transfer, and Aerodynamic Studies", Je–Chin Han, pp. 407–426, Nov., 1996.

"Proceedings of the Advanced Turbine Systems Annual Program Review Meeting", "Heat Transfer in a Two–Pass Internally Ribbed Turbine Blade Coolant Channel with Vortex Generators", S. Acharya, pp. 427–446.

"Proceedings of the Advanced Turbine Systems Annual Program Review Meeting", "Experimental and Computational Studies of Film Cooling with Compound Angle Injection", R. Goldstein, pp. 447–460, Nov., 1996.

"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, pp. 461–470, Nov., 1996.

"Proceedings of the Advanced Turbine Systems Annual Program Review Meeting", "Steam as a Turbine Blade Coolant: External Side Heat Transfer", Abraham Engeda, pp. 471–482, Nov., 1996.

"Proceedings of the Advanced Turbine Systems Annual Program Review Meeting", "Flow and Heat Transfer in Gas Turbine Disk Cavities Subject to Nonuniform External Pressure Field", Ramendra Roy, pp. 483–498, Nov., 1996.

"Proceedings of the Advanced Turbine Systems Annual Program Review Meeting", "Closed–Loop Mist/Steam Cooling for Advanced Turbine Systems", Ting Wang, pp. 499–512, Nov., 1996.

"Proceedings of the Advanced Turbine Systems Annual Program Review Meeting", "Heat Pipe Turbine Vane Cooling", Langston et al., pp. 513–534, Nov., 1996.

"Proceedings of the Advanced Turbine Systems Annual Program Review Meeting", "EPRI's Combustion Turbine Program: Status and Future Directions", Arthur Cohn, pp. 535,–552 Nov., 1996.

"Proceedings of the Advanced Turbine Systems Annual Program Review Meeting", "ATS Materials Support", Michael Karnitz, pp. 553–576, Nov., 1996.

"Proceedings of the Advanced Turbine Systems Annual Program Review Meeting", "Land Based Turbine Casting Initiative", Boyd A. Mueller, pp. 577–592, Nov., 1996.

"Proceedings of the Advanced Turbine Systems Annual Program Review Meeting", "Turbine Airfoil Manufacturing Technology", Charles S. Kortovich, pp. 593–622, Nov., 1996.
"Proceedings of the Advanced Turbine Systems Annual Program Review Meeting", "Hot Corrosion Testing of TBS's", Norman Bornstein, pp. 623–631, Nov., 1996.
"Proceedings of the Advanced Turbine Systems Annual Program Review Meeting", "Ceramic Stationary Gas Turbine", Mark van Roode, pp. 633–658, Nov., 1996.
"Proceedings of the Advanced Turbine Systems Annual Program Review Meeting", "Western European Status of Ceramics for Gas Turbines", Tibor Bornemisza, pp. 659–670, Nov., 1996.
"Proceedings of the Advanced Turbine Systems Annual Program Review Meeting", "Status of Ceramic Gas Turbines in Russia", Mark van Roode, p. 671, Nov., 1996.
"Status Report: The U.S. Department of Energy's Advanced Turbine systems Program", facsimile dated Nov. 7, 1996.
"Testing Program Results Validate GE's H Gas Turbine—High Efficiency, Low Cost of Electricity and Low Emissions", Roger Schonewald and Patrick Marolda, (no date available).
"Testing Program Results Validate GE's H Gas Turbine—High Efficiency, Low Cost of Electricity and Low Emissions", Slide Presentation—working draft, (no date available).
"The Next Step In H . . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1– Dec. 31, 1996, Publication Date, Jun. 1, 1997, Report Nos.: DOE/MC/31176–5628.
"Utility Advanced Turbine System (ATS) Technology Readiness Testing—Phase 3", Document #666274, Oct. 1, 1996–Sep. 30, 1997, Publication Date, Dec. 31, 1997, Report Nos.: DOE/MC/31176–10.
"Utility Advanced Turbine System (ATS) Technology Readiness Testing and Pre–Commercial Demonstration, Phase 3", Document #486029, Oct. 1—Dec. 31, 1995, Publication Date, May 1, 1997, Report Nos.: DOE/MC/31176–5340.
"Utility Advanced Turbine System (ATS) Technology Readiness Testing and Pre–Commercial Demonstration—Phase 3", Document #486132, Apr. 1—Jun. 30, 1976, Publication Date, Dec. 31, 1996, Report Nos.: DOE/MC/31176—5660.
"Utility Advanced Turbine System (ATS) Technology Readiness Testing and Pre–Commercial Demonstration—Phase 3", Document #587906, Jul. 1—Sep. 30, 1995, Publication Date, Dec. 31, 1995, Report Nos.: DOE/MC/31176–5339.
"Utility Advanced Turbine System (ATS) Technology Readiness Testing and Pre–Commercial Demonstration" Document #666277, Apr. 1—Jun. 30, 1997, Publication Date, Dec. 31, 1997, Report Nos.: DOE/MC/31176–8.
"Utility Advanced Turbine System (ATS) Technology Readiness Testing and Pre–Commercialization Demonstration" Jan. 1—Mar. 31, 1996, DOE/MC/31176–5338.
"Utility Advanced Turbine System (ATS) Technology Readiness Testing: Phase 3R", Document #756552, Apr. 1—Jun. 30, 1999, Publication Date, Sep. 1, 1999, Report Nos.: DE—FC21–95MC31176–23.
"Utility Advanced Turbine System (ATS) Technology Readiness Testing.", Document #656823, Jan. 1—Mar. 31, 1998, Publication Date, Aug. 1, 1998, Report Nos.: DOE/MC/31176–17.
"Utility Advanced Turbine Systems (ATS) Technology Readiness Testing and Pre–Commercial Demonstration", Annual Technical Progress Report, Reporting Period: Jul. 1, 1995 –Sep. 30, 1996.
"Utility Advanced Turbine Systems (ATS) Technology Readiness Testing", Phase 3R, Annual Technical Progress Report, Reporting Period: Oct. 1, 1997—Sep. 30, 1998.
"Utility Advanced Turbine Systems (ATS) Technology Readiness Testing", Document #750405, Oct. 1—Dec. 30, 1998, Publication Date: May, 1, 1999, Report Nos.: DE–FC21–95MC31176–20.
"Utility Advanced Turbine Systems (ATS) Technology Readiness Testing", Document #1348, Apr. 1—Jun. 29, 1998, Publication Date Oct. 29, 1998, Report Nos. DE–FC21–95MC31176–18.
"Utility Advanced Turbine Systems (ATS) Technology Readiness Testing—Phase 3", Annual Technical Progress Report, Reporting Period: Oct. 1, 1996—Sep. 20, 1997.
"Utility Advanced Turbine Systems (ATS) Technology Readiness Testing and Pre–Commercial Demonstration", Quarterly Report, Jan. 1—Mar. 31, 1997, Document #666275, Report Nos.: DOE/MC/31176–07.
"Proceedings of the 1997 Advanced Turbine Systems", Annual Program Review Meeting, Oct. 28–29, 1997.

* cited by examiner

BUCKET TIP CLEARANCE CONTROL SYSTEM

BACKGROUND OF THE INVENTION

This invention relates generally to land-based, i.e., industrial gas turbines and, more particularly, to a gas turbine bucket tip clearance control system including a flow circuit within a turbine outer shroud that controls a temperature of the outer shroud via a thermal medium.

Hot gas path components in gas turbines typically employ air convection and air film techniques for cooling surfaces exposed to high temperatures. High pressure air is conventionally bled from the compressor, and the energy of compressing the air is lost after the air is used for cooling. In current heavy duty gas turbines for electric power generation applications, the stationary hot gas path turbine components are attached directly to massive turbine housing structures, and the shrouds are susceptible to bucket tip clearance rubs as the turbine casing thermally distorts. That is, the thermal growth of the turbine casing during steady state and transient operations is not actively controlled, and bucket tip clearance is therefore subject to the thermal characteristics of the turbine. Bucket tip clearance in these heavy duty industrial gas turbines is typically determined by a maximum closure between the shrouds and the bucket tips (which usually occurs during a transient) and all tolerances and unknowns associated with steady state operation of the rotor and stator.

In some turbine designs, the stage 1 bucket is unshrouded because of complex aerodynamic loading and the stress carrying capability of the bucket. That is, the stage 1 bucket tip has no sealing mechanisms to prevent hot gas from flowing over the bucket tip. It is desirable to maintain a minimum clearance between the bucket tip and the turbine inner shroud so that an amount of hot gas flow that bypasses the turbine (and therefore is not expanded for work) is minimized.

BRIEF SUMMARY OF THE INVENTION

In an exemplary embodiment of the invention, a bucket tip clearance control system forms part of a turbomachinery apparatus including a casing, an outer shroud in a slip fit configuration with the casing, and an inner shroud coupled to the outer shroud. The tip clearance control system includes a flow circuit for a thermal medium, wherein the flow circuit defines a flow path within the outer shroud. A thermal medium source is provided in fluid communication with the flow circuit and delivers the thermal medium to the flow circuit in a predefined condition according to operating parameters of the turbomachinery apparatus, such as steady state operation and transient state operation. The temperature of the outer shroud is controlled according to the predefined temperature conditioning of the thermal medium.

Preferably, the outer shroud of the turbomachinery apparatus includes an upper half secured to a lower half at the horizontal engine split line. In this context, the flow circuit may include at least two cavities in the outer shroud, one of the cavities being disposed adjacent the split line. The flow circuit may include a first flow path within the upper half of the outer shroud and a second flow path within the lower half of the outer shroud. In this context, the flow circuit preferably includes at least two cavities in each of the first flow path and the second flow path, one of the cavities in each of the first and second flow paths being disposed adjacent the split line. In one arrangement, the flow circuit includes four cavities in the outer shroud. These cavities preferably communicate via at least one hole from cavity to cavity or via an array of metering holes from one cavity to another cavity.

DETAILED DESCRIPTION OF THE INVENTION

Figure 1:
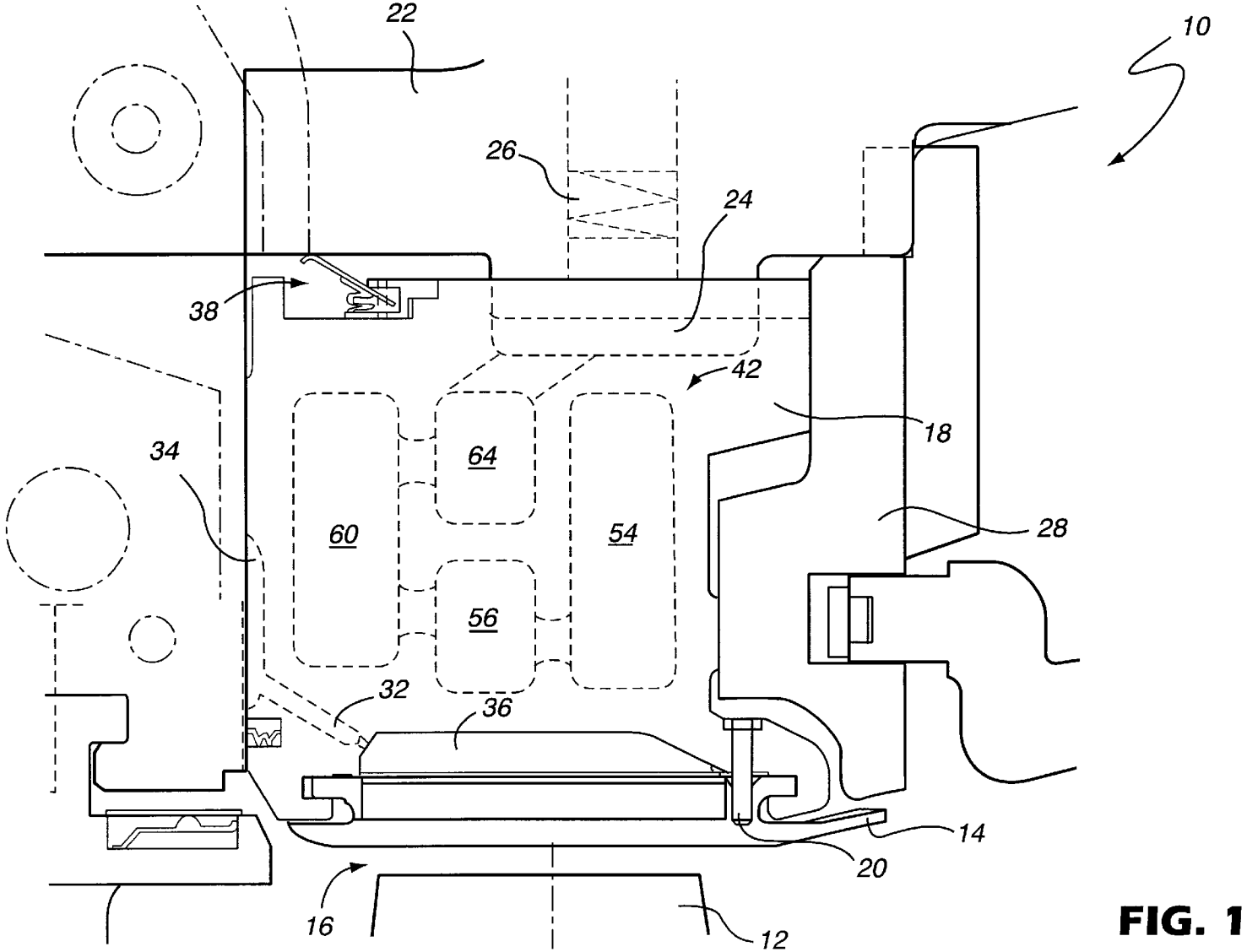
FIG. 1 is a cross-sectional view through a portion of a gas turbine, showing the turbine outer casing, outer shroud, inner shroud and first stage bucket tip.

Different gas turbine models incorporate different components for desired results, operation and the like. One design includes inner and outer shells with four stages of the inner shell mounting the first and second stage nozzles as well as the first and second stage shrouds, while the outer shell mounts the third and fourth stage nozzles and shrouds. An example of such a turbine design is described in U.S. Pat. No. 6,082,963. An alternative turbine design, which is the subject of the present invention, does not include inner and outer shells, but rather includes an outer casing, an outer stator shroud, and an inner stator shroud disposed adjacent a first stage bucket, which in this design is unshrouded. With reference to FIG. 1, the unshrouded first stage bucket is shown at 12. The gas turbine 10 includes an inner stator shroud 14 disposed adjacent the first stage bucket 12 defining a bucket tip clearance 16 between the inner stator shroud 14 and the first stage bucket 12. An outer stator shroud 18 supports the inner stator shroud 14 radially and axially by hooks 24 and circumferentially by pins 20 or the like. An outer casing 22 is coupled with the outer stator shroud 18. One method of coupling the outer shroud 18 to the turbine casing 22 is a pin scheme similar to that of the inner/outer shell design noted in the patent referenced above. Using this method, the first stage turbine nozzle and shroud can be removed and replaced without removing the entire rotor structure. Another method of attaching the outer shroud 18 to the turbine casing uses transverse hooks 24 in the turbine case 22 and the outer shroud 18. These hooks 24 have ample clearance to accommodate the radial and circumferential relative motion between the casing 22 and the shroud 18. This method allows radial expansion with ease of assembly and attachment. Small spring-loaded pins 26 can be installed through the turbine casing 22 to hold down the outer shroud 18 and reduce vibrations. The assembly process would be to install a stage 2 nozzle hanger 28 into the turbine casing 22, then lower an outer shroud ring assembly of the outer shroud 18 over the transverse hooks 24 until it rests on the nozzle hanger 28. Of course, the turbine casing can be coupled with the outer shroud, and similarly the outer shroud coupled with the inner shroud, in any known manner accommodating relative radial and circumferential motion between the casing 22 and the shroud 18. Since the specific coupling between these components does not form part of the present invention, additional details thereof will not be further described.

Figure 2:
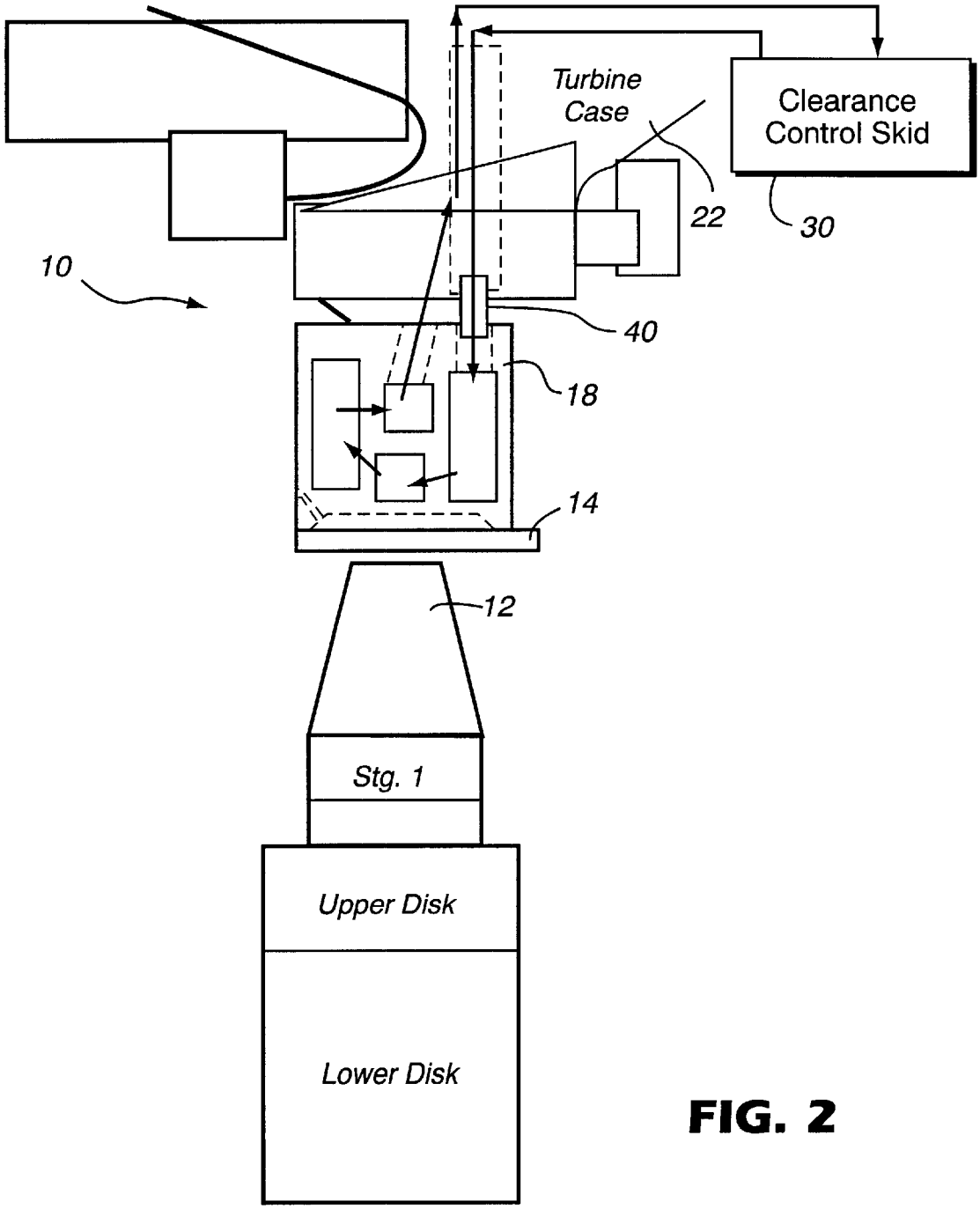
FIG. 2 is a schematic illustration of the tip clearance control system of the invention.

The outer shroud 18 of the invention is modified from its known construction to accept externally conditioned air (or other suitable fluid medium) flow. As shown in FIG. 2, the external source of air flow comprises a clearance control skid 30 that includes heat exchange components and the like to effect temperature conditioned fluid flow. In this context, the heat exchange components of the clearance control skid 30 can supply cooled air flow or heated air flow according to turbine operating conditions (discussed below). The air flow is conditioned to control the temperature of the outer shroud 18 and thus its radial growth. When the radial position of the outer shroud 18 and thus its attached inner shroud 14 can be externally controlled independent of gas turbine operation, the resulting tip clearance 16 can be chosen to provide optimum turbine efficiency and power generation with minimum risk of rubbing during transient operation (start-up, cool-down, hot restart, etc.).

The outer shroud 18 is preferably formed of two half ring pieces that are bolted together at each horizontal joint and include cloth seals or the like for preventing leakage to form a complete ring encircling the bucket tip circumference. The outer shroud 18 may be fabricated from machined forged plates that are welded together. As an alternative, the outer shroud can be cast, which would minimize machining costs. The size, material and ease of core access makes the outer shroud 18 suitable for a casting process.

High pressure air bled from the compressor existing above the stage 1 nozzle inlets provides flow into tubes 32 via scallops 34 machined into the side of the outer shroud 18. A metering orifice (not shown) may be disposed at the bottom of the supply holes just prior to entering the inner shroud supply plenum 36. Preferably, the size and number of scallops 34, flow tubes 32 and the subsequent metering orifice diameter are optimized to closely match design requirements. An upper leaf seal 38 covers most of the circumference of the outer shroud 18, except locally at the horizontal engine split line joint, where bolting of the two halves of the outer shroud 18 occurs, thus sealing compressor discharged air from leaking aft.

Externally supplied flow from the clearance control skid 30 provides temperature conditioned air into the outer shroud 18 from suitable connectors that enable fluid flow between components. One such suitable connector is a so-called "spoolie" that is described in, for example, commonly owned U.S. Pat. No. 5,593,274, the contents of which are hereby incorporated by reference. The spoolies 40 or like connectors penetrate the turbine casing 22 at or near a top dead center (TDC) position and a bottom dead center (BDC) position of the engine. In a preferred configuration, four spoolies 40 are included, one at each inlet and exit at both TDC and BDC.

Figure 3:
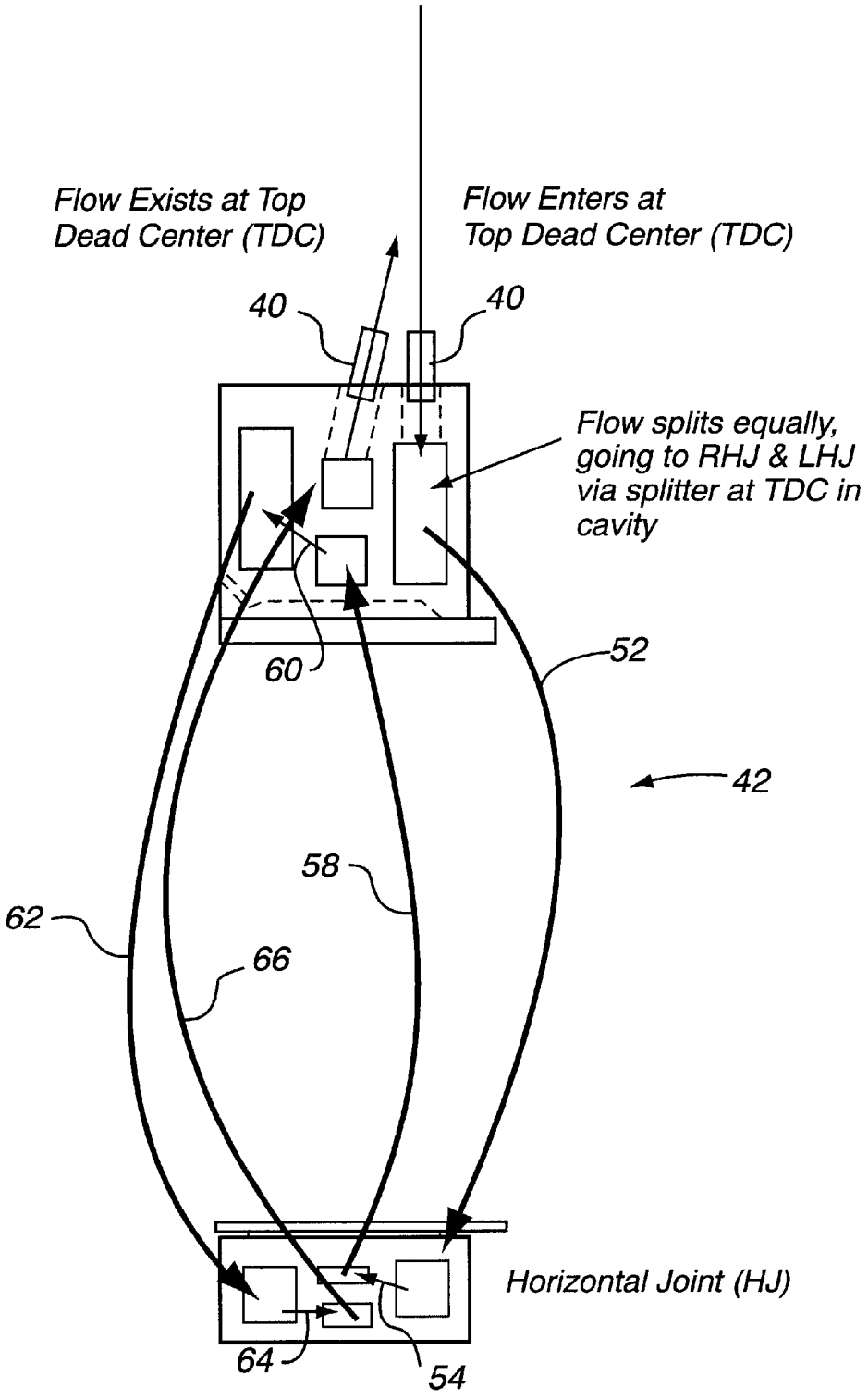
FIG. 3 is a schematic illustration of an upper half flow circuit.
Figure 4:
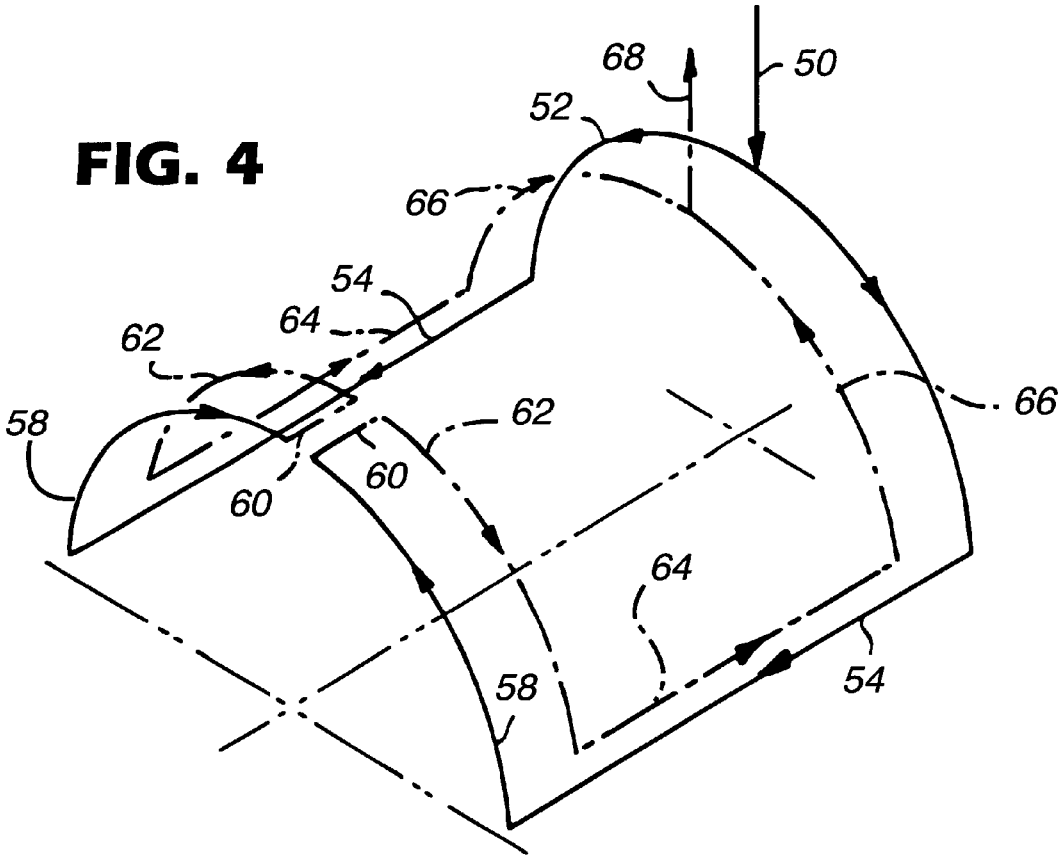
FIGS. 4 and 5 illustrate the upper half flow circuit shaped corresponding to an upper half of the outer shroud.

With continued reference to FIG. 1 and with reference to FIGS. 3 and 4, a closed circuit 42 for conditioned air from the clearance control skid 30 is defined by a plurality of cavities within the outer shroud 18. The flow circuit 42 defines a flow path within the outer shroud for the conditioned flow from the clearance control skid 30. As discussed above, since the outer shroud 18 includes an upper half secured to a lower half at a split line, each half of the outer shroud 18 includes a separate inlet and outlet for conditioned flow and separate flow paths, respectively. Although the inlets to the upper and lower halves of the outer shroud 18 are separate, all conditioned flow is preferably provided by a single clearance control skid 30, ensuring that uniform temperature conditioned flow is supplied to both halves of the shroud 18. This prevents detrimental distortion of the shroud 18 due to non-uniform temperature conditioning fluid medium. Alternatively, multiple clearance control skids 30 could be used to supply each of the upper or lower halves of the shroud 18. Since the respective flow circuits of the upper and lower halves of the outer shroud 18 are substantially identical, the flow circuit 42 in the upper half of the outer shroud 18 only will be described.

Figure 5:
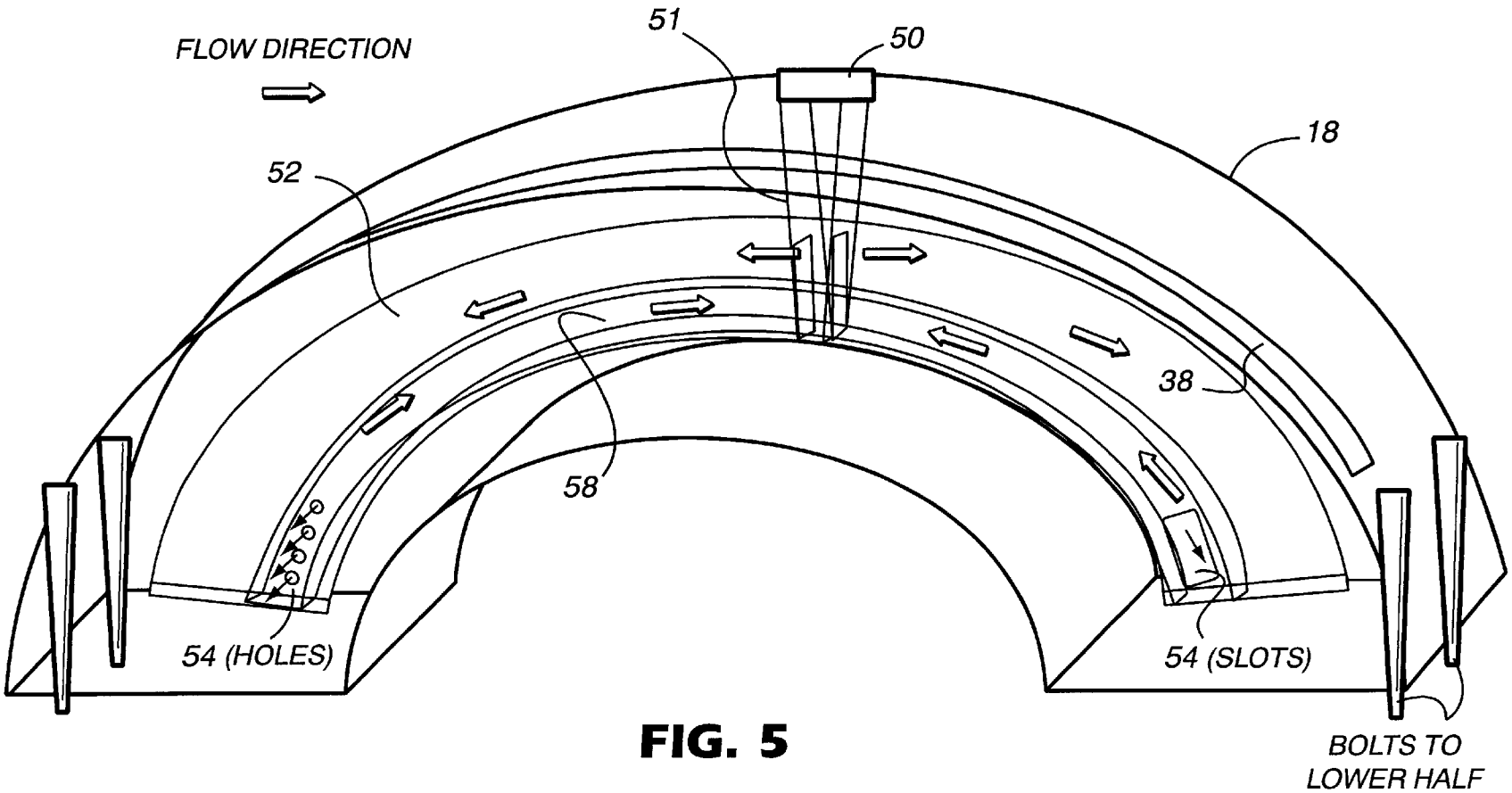

The conditioned flow from the clearance control skid 30 enters the flow circuit through the spoolie 40 at TDC (and BDC). The flow is split at the inlet 50 (FIGS. 4 and 5) by a component 51 that extends from the inlet 50 locally to the bottom inlet cavity of 52. The conditioning flow is then sent circumferentially via 52 nearly to each horizontal joint within each outer shroud half. The flow is ported through one or more holes from a first end cavity 54 to a second end cavity 56. More than one hole may be used for porting flow between cavities along with other small diameter holes farther circumferentially back in the flow path to accommodate casting core support. Alternatively, a large slot may connect the two end cavities. The flow in the second end cavity 56 is then directed circumferentially back toward TDC via 58 to a third cavity 60 at TDC again through one or more large holes or series of smaller holes. The flow path continues from TDC back to the horizontal split line of the engine within the third cavity 60 via 62 and passes from the third cavity 60 to a fourth cavity 64. The flow travels back up to TDC in the fourth cavity 64 via 66, which acts as a heat exchanger to the first cavity 54, the second cavity 56 and the third cavity 60 to minimize thermal gradients and overall fluid heat up. Thermal gradients would cause detrimental distortions in the shroud 18 and defeat the purpose of creating a uniformly round static structure to encircle the rotating blades or buckets, and provide an optimized, performance enhancing tip clearance. Finally, the flow exits the outer shroud 18 through a slot outlet 68 that is circumferentially out of plane with the inlet spoolies at TDC, i.e., at the same radial diameter and axial station, just moved circumferentially (e.g., 15 degrees) from TDC. The flow is collected in an outlet spoolie and then piped back to the clearance control skid 30 where the closed loop flow circuit starts over. When the flow in the second cavity 56 follows circumferentially back to TDC, the flow acts as a log mean temperature difference heat exchanger within the outer shroud 18. That is, the small higher velocity center cavities act as buffering cavities between the large low velocity cold cavity at the back and the low velocity hot cavity at the front, which if adjacent each other could create large thermal gradients within the shroud structure. In flowing back and forth (i.e., top to horizontal) and back and differing velocities the heat of the internal flow in each cavity will conduct to the adjacent cavity creating a heat exchanger between the two cavities and minimizing the given heat up in any one cavity. The method of calculating these fluid heat ups is known as log mean temperature difference.

With the structure of the present invention, internal passages within the outer shroud define a flow path of a flow circuit that condition the outer shroud for minimum thermal gradients (stress) and optimum uniform growth. By assembling the outer shroud in halves, the occurrences of leakage is reduced as compared to existing components while allowing the inner shroud to be positioned optimal to the bucket tip. The clearance control skid communicating with the flow circuit can provide heated flow during transients to move the inner shroud away from the rotor. Subsequently, during steady state operation, the clearance control skid can controllably supply cooling flow to shrink the tip clearance thereby improving efficiency and output.

While the invention has been described in connection with what is presently considered to be the most practical and preferred embodiments, it is to be understood that the invention is not to be limited to the disclosed embodiments, but on the contrary, is intended to cover various modifications. and equivalent arrangements included within the spirit and scope of the appended claims.

What is claimed is:

1. A bucket tip clearance control system that forms part of a turbomachinery apparatus including a casing, an outer shroud coupled with the casing, and an inner shroud coupled with the outer shroud, the outer shroud supporting the inner shroud directly adjacent a bucket tip with a bucket tip clearance between them, the tip clearance control system comprising:

a flow circuit for a thermal medium, the flow circuit defining an internal flow path within the outer shroud; and a thermal medium source in fluid communication with the flow circuit, the thermal medium source delivering the thermal medium to the flow circuit in a predefined condition according to operating parameters of the turbomachinery apparatus, wherein a temperature of the outer shroud is controlled according to the predefined condition of the thermal medium.

2. A bucket tip clearance control system according to claim 1, wherein the outer shroud of the turbomachinery apparatus comprises an upper half secured to a lower half at a split line, and wherein the flow circuit comprises at least two cavities in the outer shroud, one of the cavities being disposed in a vicinity of the split line.

3. A bucket tip clearance control system according to claim 2, wherein the flow circuit comprises a first flow path within the upper half of the outer shroud and a second flow path within the lower half of the outer shroud, and wherein the flow circuit comprises at least two cavities in each of the first flow path and the second flow path, one of the cavities in each of the first and second flow paths being disposed in a vicinity of the split line.

4. A bucket tip clearance control system according to claim 1, wherein the flow circuit comprises four cavities in the outer shroud.

5. A bucket tip clearance control system according to claim 4, wherein the four cavities communicate via at least one hole from cavity to cavity.

6. A bucket tip clearance control system according to claim 5, wherein the four cavities communicate via a series of holes from cavity to cavity.

7. A bucket tip clearance control system according to claim 1, wherein the operating parameters comprise steady state turbomachinery operation and transient state turbomachinery operation.

8. A turbomachinery apparatus comprising:

a first stage bucket without a bucket shroud;

an inner stator shroud disposed adjacent the first stage bucket defining a bucket tip clearance between the inner stator shroud and the first stage bucket;

an outer stator shroud supporting the inner stator shroud for relative radial movement;

an outer casing coupled with the outer stator shroud; and a bucket tip clearance control system for controlling the bucket tip clearance, the tip clearance control system comprising (1) a flow circuit for a thermal medium, the flow circuit defining an internal flow path within the outer stator shroud, and (2) a thermal medium source in fluid communication with the flow circuit, the thermal medium source delivering the thermal medium to the flow circuit in a predefined condition according to operating parameters of the turbomachinery apparatus, wherein a temperature of the outer stator shroud is controlled according to the predefined condition of the thermal medium.

9. A turbomachinery apparatus according to claim 8, wherein the outer stator shroud comprises an upper half secured to a lower half at a split line, and wherein the flow circuit comprises at least two cavities in the outer stator shroud, one of the cavities being disposed in a vicinity of the split line.

10. A turbomachinery apparatus according to claim 9, wherein the flow circuit comprises a first flow path within the upper half of the outer stator shroud and a second flow path within the lower half of the outer stator shroud, and wherein the flow circuit comprises at least two cavities in each of the first flow path and the second flow path, one of the cavities in each of the first and second flow paths being disposed in a vicinity of the split line.

11. A turbomachinery apparatus according to claim 8, wherein the flow circuit comprises four cavities in the outer stator shroud.

12. A method of controlling bucket tip clearance in a turbomachinery apparatus including a casing, an outer shroud coupled with the casing, and an inner shroud coupled with the outer shroud, the method comprising:

providing a flow circuit for a thermal medium, and defining an internal flow path via the flow circuit within the outer shroud;

delivering the thermal medium to the flow circuit in a predefined condition according to operating parameters of the turbomachinery apparatus; and controlling a temperature of the outer shroud according to the predefined condition of the thermal medium.

* * * * *

UNITED STATES PATENT AND TRADEMARK OFFICE

CERTIFICATE OF CORRECTION

PATENT NO. : 6,435,823 B1
APPLICATION NO. : 09/731907
DATED : August 20, 2002
INVENTOR(S) : Schroder It is certified that error appears in the above-identified patent and that said Letters Patent is hereby corrected as shown below:

In Column 1, immediately below the title, insert:

--The Government of the United States of America has rights in this invention pursuant to Contract No. DE-FC21-95MC31176 awarded by the U. S. Department of Energy.--

Signed and Sealed this

Seventeenth Day of July, 2007

JON W. DUDAS
*Director of the United States Patent and Trademark Office*